US007088042B2

(12) United States Patent
Hirota et al.

(10) Patent No.: US 7,088,042 B2
(45) **Date of Patent: *Aug. 8, 2006**

(54) FLAT DISPLAY DEVICE

(75) Inventors: Takatoshi Hirota, Kawasaki (JP); Hideo Kimura, Kawasaki (JP); Kazuo Imaoka, Kawasaki (JP); Satoshi Yokoyama, Kawasaki (JP); Mitsuharu Sato, Kawasaki (JP); Shiro Naoi, Kawasaki (JP); Takaaki Onoe, Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 0 days.

This patent is subject to a terminal disclaimer.

(21) Appl. No.: 10/674,476

(22) Filed: Oct. 1, 2003

(65) Prior Publication Data

US 2004/0095068 A1 May 20, 2004

Related U.S. Application Data

(60) Continuation of application No. 09/819,983, filed on Mar. 29, 2001, now Pat. No. 6,630,789, which is a division of application No. 08/867,846, filed on Jun. 3, 1997, now Pat. No. 6,297,582.

(30) Foreign Application Priority Data

Jun. 12, 1996 (JP) ..... 8-151276

(51) Int. Cl.
*H01J 17/49* (2006.01)

(52) U.S. Cl. ..... 313/582; 313/112; 313/113; 313/586; 313/643

(58) Field of Classification Search ..... 313/110, 313/112, 113, 581–587, 637, 643
See application file for complete search history.

(56) References Cited

U.S. PATENT DOCUMENTS

| | | | | |
|---|---|---|---|---|
| 3,904,915 | A | | 9/1975 | Hinson |
| 4,065,698 | A | * | 12/1977 | Owaki et al. ..... 313/489 |
| 4,692,662 | A | * | 9/1987 | Wada et al. ..... 313/493 |
| 4,723,093 | A | | 2/1988 | Nolan |
| 4,833,463 | A | | 5/1989 | Dick et al. |
| 5,541,479 | A | * | 7/1996 | Nagakubo ..... 313/586 |
| 5,581,152 | A | * | 12/1996 | Matsuno et al. ..... 313/634 |
| 5,804,102 | A | | 9/1998 | Oi et al. |
| 5,811,923 | A | | 9/1998 | Zieba et al. |
| 6,104,530 | A | | 8/2000 | Okamura et al. |

FOREIGN PATENT DOCUMENTS

| | | |
|---|---|---|
| EP | 0 074 440 | 3/1983 |
| EP | 0 782 164 | 7/1997 |
| JP | 2-256144 | 10/1990 |
| JP | 5205643 | 8/1993 |
| JP | 6075219 | 3/1994 |
| JP | 7013146 | 1/1995 |
| JP | 8-55581 | 2/1996 |
| JP | 8055581 | 2/1996 |

(Continued)

OTHER PUBLICATIONS

"Plasma Display", Article, Nov. 15, 1983, pp. 42-47.

(Continued)

*Primary Examiner*—Ashok Patel
(74) *Attorney, Agent, or Firm*—Staas & Halsey LLP

(57) ABSTRACT

In a flat display device having a pair of substrates for defining a gas discharge space in which a gas used to generate discharge luminance is sealed, means for absorbing or reflecting near infrared rays is included.

11 Claims, 13 Drawing Sheets

FOREIGN PATENT DOCUMENTS

| | | |
|---|---|---|
| JP | 9145918 | 6/1997 |
| WO | WO 96 06453 | 2/1996 |

OTHER PUBLICATIONS

Handbook of Optical Art, Oct. 26, 1968, pp. 716-718.
Handbook of Optical Technology, Feb. 20, 1986, pp. 566-574.
Database WPI, Week 9733, Derwent Publications Ltd., London, GB; AN 354398, XP002041346 & JP 09 145 919 (Fujitsu), Jun. 6, 1997 *abstract* & JP 09 145 919 A.
Database WPI, Week 9733, Derwent Publications Ltd., London, GB; AN 354397, XP002041347 & JP 09 145 918 (Fujitsu), Jun. 6, 1997 *abstract* & JP 09 145 918 A.
K. Amemiya et al.; "Luminance Observed above the Anode electrode in Co-Planar Structure AC-PDP", ASIA Display '95, ASIA Display '95 meeting of SID (Society for Information Display), Oct. 16-18, 1995, pp. 965-966.

* cited by examiner

FLAT DISPLAY DEVICE

This application is a continuation of application Ser. No. 09/819,983, filed Mar. 29, 2001, now allowed, which is now U.S. Pat. No. 6,630,789 divisional of application Ser. No. 08/867,846 filed Jun. 3, 1997 which is now U.S. Pat. No. 6,297,582 issued Oct. 2, 2001.

BACKGROUND OF THE INVENTION

1. Field of the Invention

The present invention relates to a flat display device and, more particularly, to a flat display device used as an image display for use in computer, television, and the like.

2. Description of the Prior Art

The plasma display panel (referred to as PDP hereinafter) as a flat display device has been put into practical use of a display device such as a wall hanging television set. PDPs are classified into AC type and DC type according to difference in voltage drive system. In most cases, a display portion of an AC type color PDP has a structure shown in FIG. 1, for example.

In FIG. 1, address electrodes 102 and a fluorescent layer for covering these address electrodes 102 are formed on a back glass substrate 101. A dielectric layer 105, a pair of display electrodes 106, 107, a protection layer 108, etc. are formed on a front glass substrate 104 opposing to the back glass substrate 101. In addition, a gas is sealed into a discharge space 109 between the front glass substrate 104 and the back glass substrate 101.

In practical use of such PDP, lifetime of the panel, operating voltage, emission luminance, chromatic purity and so on are to be considered as important evaluation factors. These evaluation factors are significantly affected by gas mixture which is sealed into the discharge space 109.

Various investigations about such gas mixture have been performed. By using two component gas mixture consisting of neon (Ne) and xenon (Xe), or helium (He) and xenon, otherwise three component gas mixture consisting of helium, argon (Ar) and xenon, or neon, argon and xenon, such PDPs having long lifetime, low operating voltage, and in addition sufficient luminous brightness are going to be achieved.

Lights having wavelength other than visible ray, e.g., near infrared rays are emitted from PDPs using such gas mixture.

Such facts have been made clear by the inventors of the present invention that there are possibilities that such near infrared rays cause a harmful influence on transmission of infrared data in the POS (point of sales) computor information system used in the location where PDP is established, or cause malfunction of near infrared remote control for domestic electric appliances in the home where PDP is used as the television set.

These facts have not known until now, and they have been found at first by the inventors of the present invention.

SUMMARY OF THE INVENTION

The present invention has been made to solve such problems, and an object of the present invention is to provide a flat display device capable of cut off unnecessary lights for image display and improving quality of image display.

According to the present invention, since the flat display device is provided with means for reflecting or absorbing at least near infrared rays in wavelength bandwidth other than visible rays, malfunction of the devices operated by near infrared rays can be prevented. In addition, if an optical film serving as an anti-reflection film with respect to visible ray wavelengths and serving as a reflection film with respect to near infrared wavelengths is used as means for reflecting or absorbing near infrared rays, visible rays can be emitted from the flat display device to the outside without reflection and absorption in the flat display device. For this reason, deterioration in luminous display brightness of the flat display device can be prevented.

Further, since the flat display device is provided with the electromagnetic wave shielding film as well as means for reflecting or absorbing near infrared rays, harmful influence upon a human body can be suppressed. The electromagnetic wave shielding film may be formed of a lamination film, or a growth film deposited in terms of sputtering, CVD, evaporation, and the like.

Furthermore, in the flat display device, if the protection plate consisting of glass, acrylic resin, or plastic is arranged in front of the substrates which define the discharge space, radiation of the light having shorter wavelength than visible rays can be suppressed and also the structure of the device can be strengthened. If the protection plate is formed to have a convex shape or the periphery of the protection plate is fitted into the frame member, structural strength of the protection plate can be improved.

In the present invention, since xenon and neon are included in the gas discharge space in the flat display device such that xenon comprises a less than 2% of the total, the radiant quantity of the light emitted from the flat display device and having 800 nm to 1200 nm wavelength can be extremely reduced. Therefore, harmful influence of the flat display panel upon the devices operated by near infrared rays can be prevented. Besides, quality of color display near the flat display panel can be improved. In the flat display panel, since there is a possibility to increase the radiant quantity of the light around about 700 nm, optical intensity at the wavelength can be reduced by providing means for absorbing or reflecting the light having the wavelength beyond 650 nm to thus suppress deterioration in chromatic purity and chromaticity of color display.

In this event, if transmittance of the light having the wavelength below 650 nm is set more than twice as high as transmittance of the light having the wavelength of 700 nm, optical intensity at the wavelength can be reduced to thus suppress deterioration in chromatic purity and chromaticity of color display.

In the present invention, if the mixture ratio of the gas is set such that spectrum intensity of infrared rays is less than the half of spectrum intensity of visible ray wavelength in the gas discharge space of the flat display device, influence upon the devices other than the flat display device can be reduced.

Other and further objects and feature of the present invention will become obvious upon an understanding of the illustrative embodiments about to be described in connection with the accompanying drawings or will be indicated in the appended claims, and various advantages not referred to herein will occur to one skilled in the art upon employing of the invention in practice.

DESCRIPTION OF THE PREFERRED EMBODIMENTS

Figure 1:
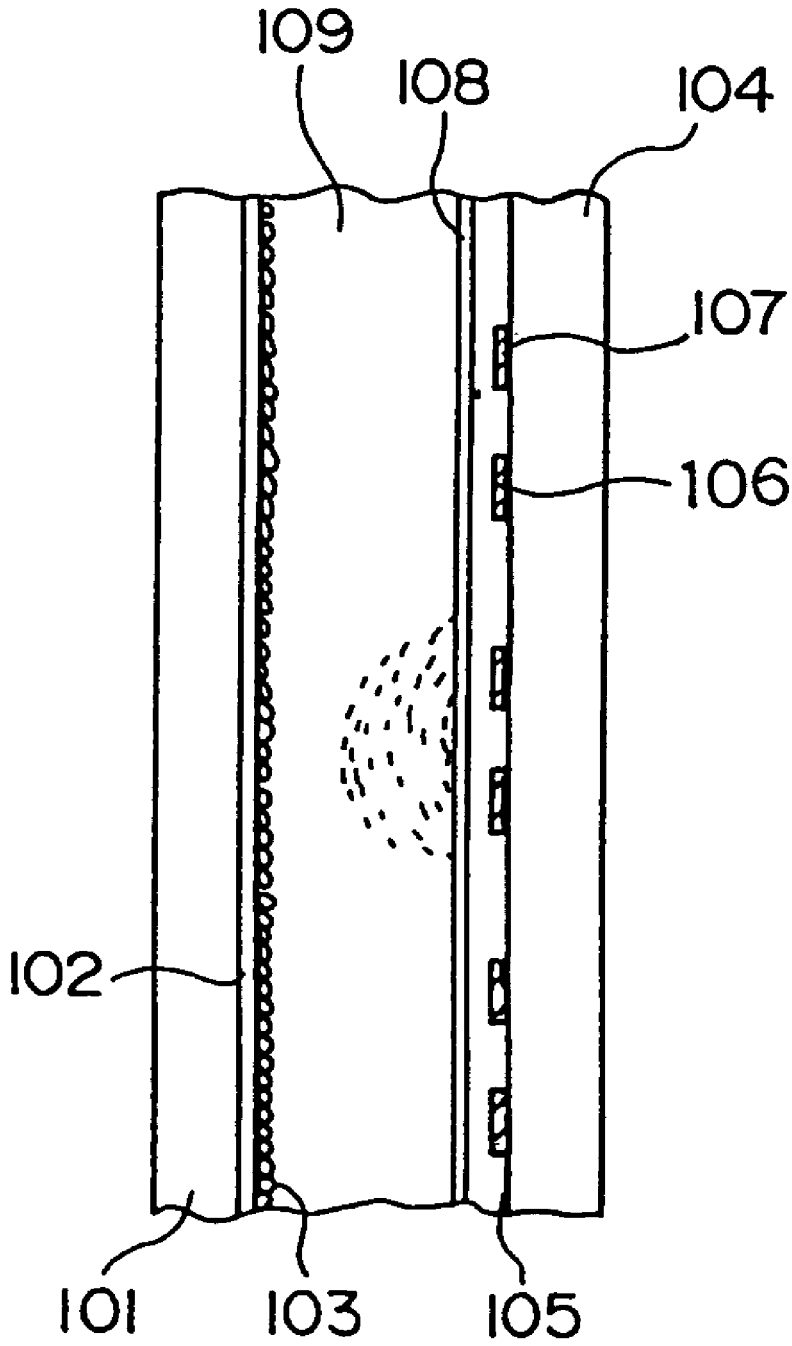
FIG. 1(Prior Art)
FIG. 1 is a sectional view showing an outline of a conventional plasma display.

There will be described various embodiments of the present invention with reference to the accompanying drawings. It should be noted that the same or similar reference numerals are applied to the same or similar parts and elements throughout the drawings, and the description of the same or similar parts and elements will be omitted or simplified.

First, when emission spectrum intensity of two component mixture gas in the wavelength range from 600 nm to 1200 nm while changing a mixture ratio of Xe to a two component gas mixture consisting of Ne and Xe, used as a gas sealed into a color PDP, the results shown in FIGS. 2A to 2C and FIGS. 3A and 3B have been achieved.

In other words, if the mixture ratio of Xe to the two component gas mixture consisting of Ne and Xe is 0.2%, a spectral peak has been observed around the wavelength of 700 nm, i.e., in the region of visible rays. In contrast, as shown in FIGS. 2B and 2C and FIGS. 3A and 3B, in the range where the mixture ratio of Xe ranges from 2.0% to 5.0%, peaks of emission spectrum appear around the wavelength of about 820 nm and about 880 nm, i.e., in the range of near infrared rays on the same order as above.

Figure 4:
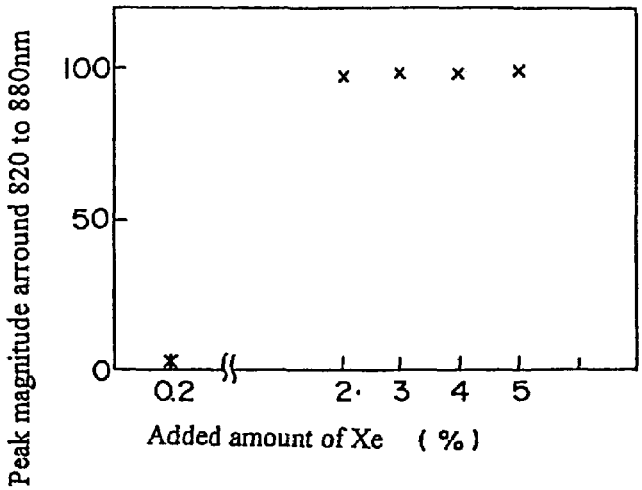
FIG. 4 is a view showing a relationship between the mixture ratio of xenon and emission spectrum intensity around the wavelength of 880 nm in the device according to the embodiment of the present invention.

Based on these experimental results, a relationship between spectrum intensity and the mixture ratio of Xe around the wavelength of about 820 nm to about 880 nm is shown in FIG. 4.

As is evident from the above, it could be considered that influence of gas mixture appears on spectrum intensity of near infrared rays. In particular, we can guess that spectrum intensity of near infrared rays may be largely caused according to the mixture ratio of Xe.

Accordingly, in order to eliminate influence on operation of POS or remote control system operated by near infrared rays, the inventors of the present invention will adopt a color PDP having a following structure.

Figure 5:
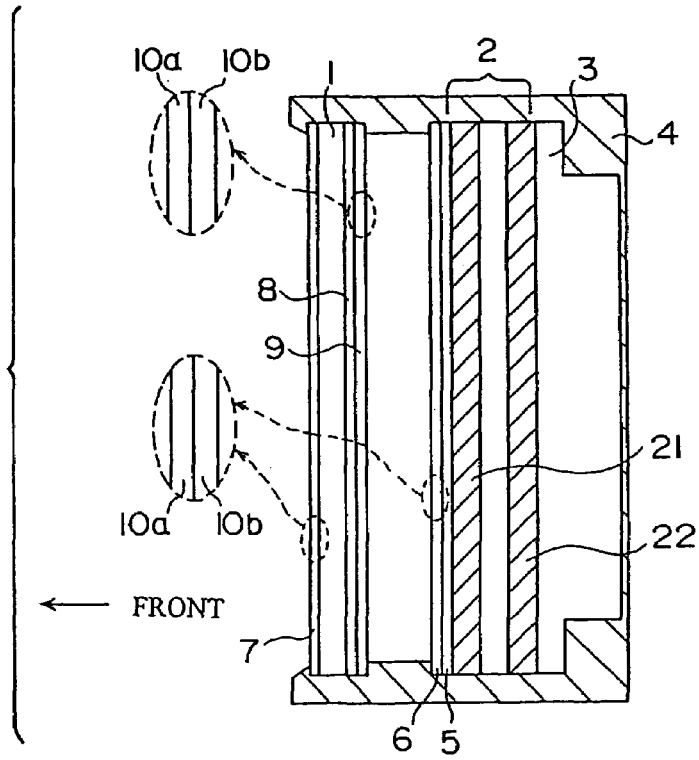
FIG. 5 is a schematic view showing a structure of the device according to the embodiment of the present invention.

FIG. 5 is a sectional view of the PDP device showing a first embodiment of the present invention.

In the PDP device shown in FIG. 5, a display panel 2, a front area of which is protected by a transparent protection plate 1, and a control portion 3 are provided to a front opened type casing 4.

Figure 6:
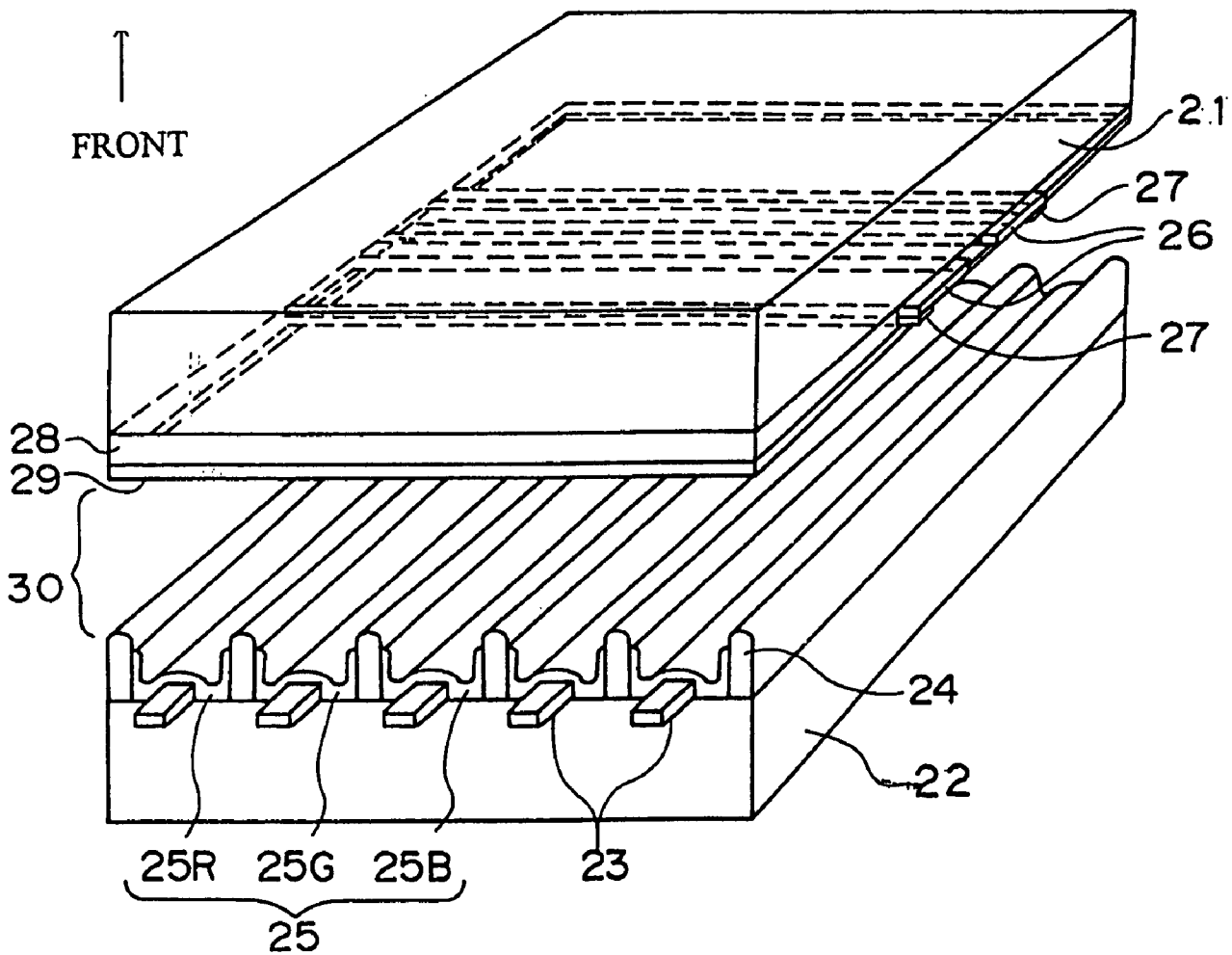
FIG. 6 is a perspective view showing an inner structure of a display panel of the device shown in FIG. 1.

The display panel 2 is made of a surface discharge panel having an AC (alternating current) type three-electrode structure, for example. As shown in FIG. 6, the display panel 2 comprises a front transparent substrate 21 formed of glass, and a back substrate 22 formed of glass. A plurality of address electrodes 23 aligned at a predetermined distance, stripe-shape partition walls 24 formed between the address electrodes 23 correspondingly, and fluorescent layers 25 covering respectively the address electrodes 23 and side surfaces of the partition walls 24 are formed on a surface area of the back substrate 22 opposing to the front transparent substrate 21.

The fluorescent layer 25 comprises a red fluorescent layer 25R, a green fluorescent layer 25G, and a blue fluorescent layer 25B, all emitting the lights when they are irradiated with ultraviolet rays, for example. The red fluorescent layer 25R, the green fluorescent layer 25G, and the blue fluorescent layer 25B are aligned in sequence to put respective partition walls 24 therebetween.

On a surface of the front transparent substrate 21 opposing to the back substrate 22 are formed display electrodes (called also as "sustain electrodes") 26 made of transparent conductive material and aligned adjacently in the direction intersecting with the address electrodes 23 so as to form a pair of electrodes respectively and metal bus electrodes 27 for supplementing their conductivity. In addition, a dielectric layer 28 for covering the display electrodes 26 and the bus electrodes 27 is formed. There are ITO (indium tin oxide), tin oxide ($SnO_2$), etc. as the transparent conductive material, while there are three-layered electrode made of Cr—Cu—Cr, etc. as the metal bus electrode 27. A surface of the dielectric layer 28 is covered with a protection layer 29 made of magnesium oxide.

The front transparent substrate 21 and the back substrate 22 are arranged to form a clearance (space) 30 between the protection layer 29 and the fluorescent layer 25, and their peripheries are hermetically sealed. The clearance 30 is filled with a gas at a low pressure. If being plasmanized, the gas may emit ultraviolet rays. For example, it is a gas mixture consisting of Xe and Ne.

On the front surface of the front transparent substrate 21 of the display panel 2 having such a structure, as shown in FIG. 5, an electromagnetic wave shielding film 5 made of transparent conductive film and a first optical film 6 described later are formed in order. The electromagnetic wave shielding film 5 shields electromagnetic wave with a frequency ranging from 30 MHz to 1 GHz and an ordinary shielding film used in a common CRT is available.

A protection plate 1 formed in front of the display panel 2 is formed of transparent material such as acrylic resin or glass. A front surface of the protection plate 1 is covered with a second optical film 7 and a back surface of the protection plate 1 is covered with an infrared absorption film 8 and a third optical film 9. Material such as glass or resin has in nature a function for cutting off the wavelength of less than 400 nm.

Figure 7:
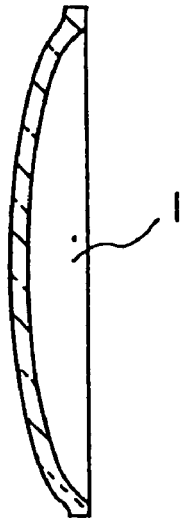
FIG. 7 is a sectional view showing an example of a convex protection plate used in the device according to the embodiment of the present invention.
Figure 8A:
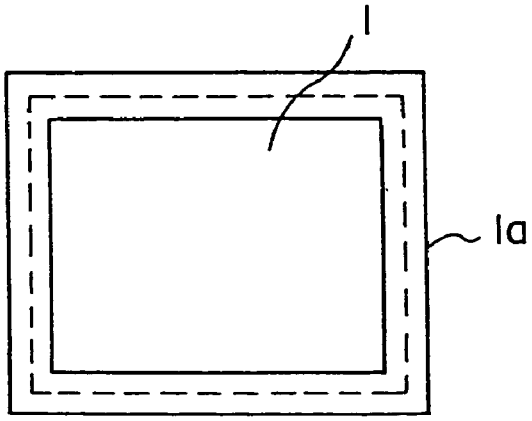
FIGS. 8A and 8B are front and side views showing an example of a protection plate with a frame used in the device according to the embodiment of the present invention respectively.
Figure 8B:
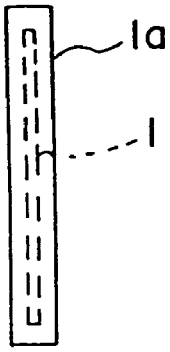

The protection plate 1 is provided to not only protect a surface of the display panel 2 but also increase strength of the overall PDP device. In order to improve structural strength of the protection plate 1 and the PDP device much more, it is preferable that the protection plate 1 is formed to have a roundish concave shape against the viewer, as shown in FIG. 7, otherwise four sides of the protection plate 1 are fitted into a frame member 1*a*, as shown in FIGS. 8A and 8B.

Figure 9:
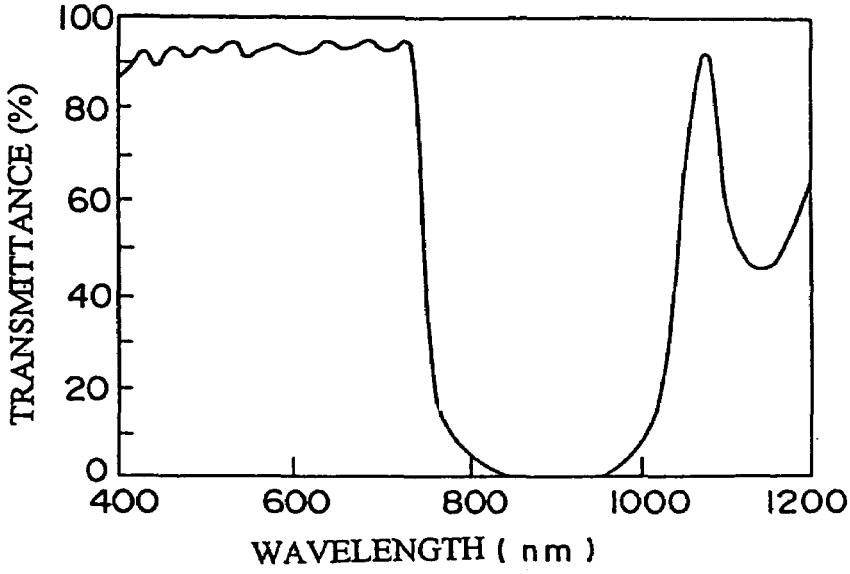
FIG. 9 is a characteristic showing optical transmittance of an example of an optical filter to reflect particular wavelengths used in the device according to the embodiment of the present invention.

The above first to third optical films 6, 7, 9 have a characteristic shown in FIG. 9, for example. Therefore, they serve as the anti-reflection film in the range of visible ray wavelength of 400 to 700 nm, but serve as the reflection film because reflectance becomes high in the range of infrared ray wavelength of about 820 to 880 nm. As such film, for instance, as shown in FIG. 5, there is a film which is formed by stacking a high refractive index film 10*a* made of either a single layer such as $TiO_2$, $Ta_2O_5$, $ZrO_2$ or a multilayer consisting of $Pr_6O_{11}$ and $TiO_2$ and a low refractive index film 10*b* made of $MgF_2$, $SiO_2$, or the like.

The low refractive index film 10*b* is arranged closed to the display panel 2. The high refractive index film 10*a* and the low refractive index film 10*b* may be stacked in a single layer respectively, or else a plurality of high refractive index films 10*a* and low refractive index films 10*b* may be stacked in repeated and alternate layers.

Figure 10:
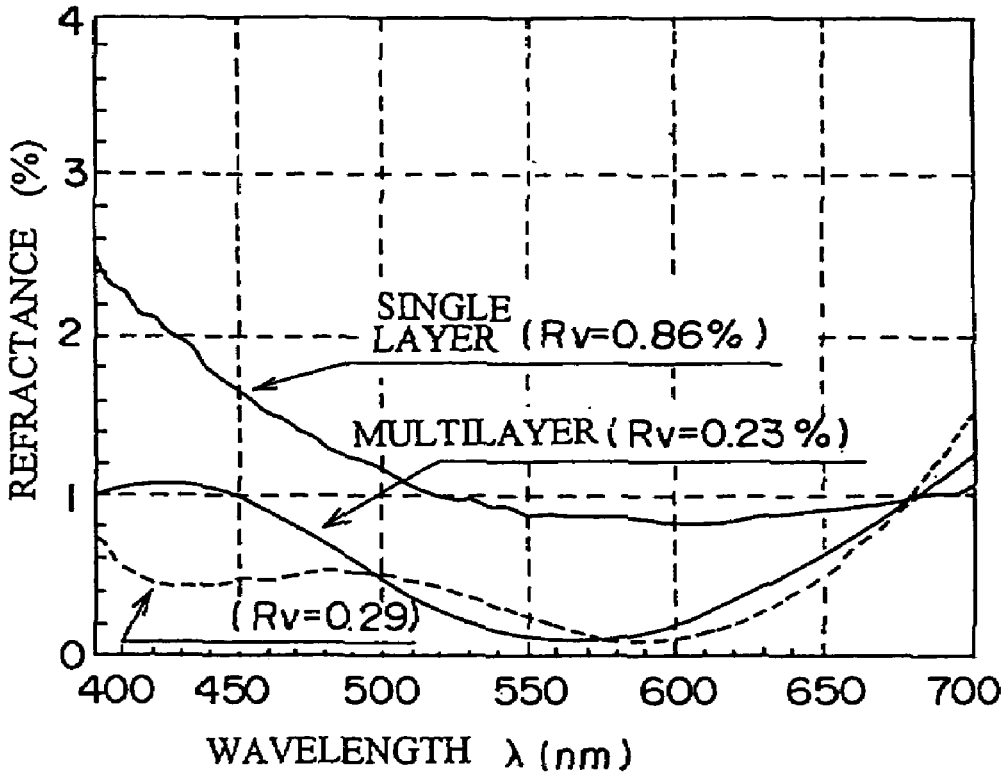
FIG. 10 is a view showing an example of characteristics of a visible-ray anti-reflection film used in the device according to the embodiment of the present invention.

Luminance average reflectance of less 0.48 is preferred in preventing reflection of visible rays. By way of example, the characteristic for reflection preventing function on a surface of the film is given in FIG. 10.

The luminance average reflectance (Rv) is given by an equation (1). Where, in the equation (1), y(fÉ) is color matching function in XYZ calorimetric system, S(y) is spectral distribution of standard illuminant used for color display, and R(fÉ) is spectral reflectance factor (%).

$$Rv= \qquad (1)$$

Figure 11:
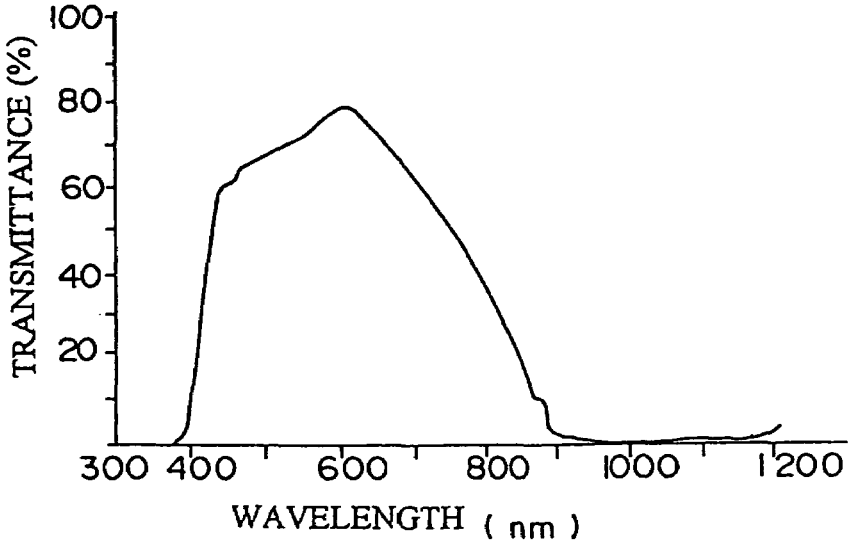
FIG. 11 is a characteristic showing an example of optical transmittance characteristics of an infrared absorption filter used in the device according to the embodiment of the present invention.

An infrared absorption film 8 is a film for absorbing at least near infrared rays, and is made of resin including organic compound dye such as anthraquinone system, phthalocyanine system, etc., or resin including dye such as organic compound of metal complex, for example. In the structure wherein the infrared absorption film 8 is stuck on a back surface of the protection plate made of acrylic resin, optical transmittance within 300 to 1200 nm is given in FIG. 11, for example. The infrared absorption film 8 may be stuck on the front surface of the protection plate 1.

Figure 12:
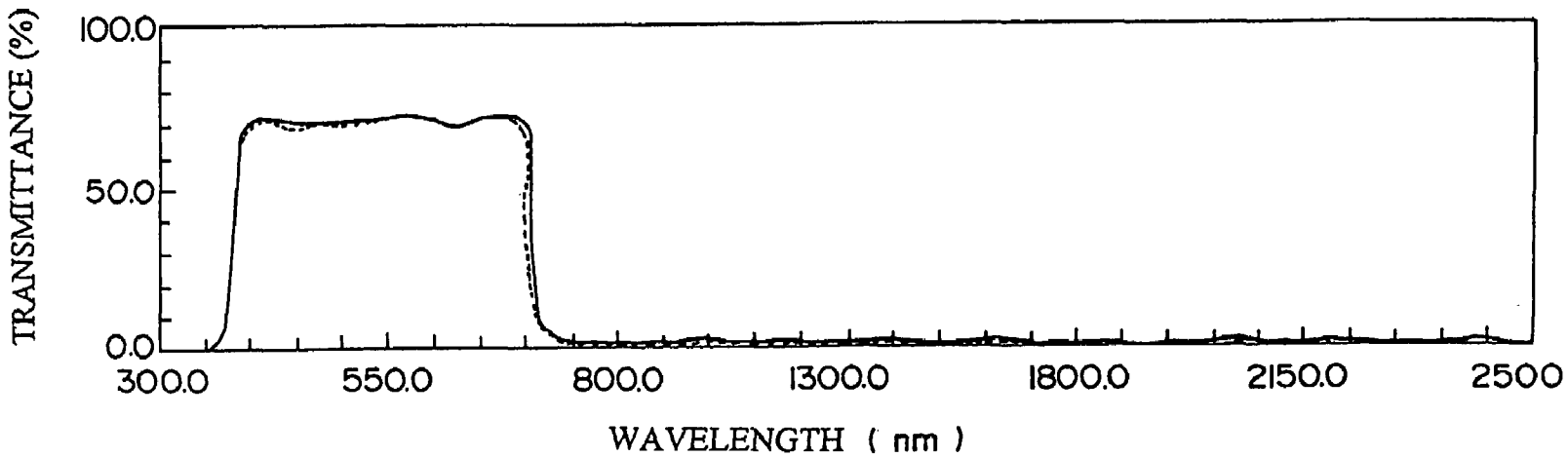
FIG. 12 is a view showing optical transmittance if the optical filter as well as the infrared absorption filter is applied to the device according to the embodiment of the present invention.

Since the spectral transmittance curve of the protection plate 1 in which the infrared absorption film 8 and the third optical film 9 are laminated is illustrated in FIG. 12, for instance, emission spectra other than the visible ray region (400 to 700 nm) are hardly emitted in the forward direction of the PDP device.

With the above, in the first embodiment, since the PDP device is provided with the infrared absorption film 8 and the first to third optical films 6, 7, 9, no malfunction of the device operated by using infrared rays occurs. Besides, since reflection of visible rays in the display panel 2 can be prevented, the PDP device which is more superior in color display than the conventional device can be achieved.

In the PDP device shown in FIG. 5, the first optical film 6 has been stuck on the front surface of the display panel 2, then the infrared absorption film 8 has been stuck on the back surface of the protection plate 1, and then the second and third optical films 7 and 9 are stuck on the front and back surfaces of the protection plate 1 respectively. However, all of the infrared absorption film 8 and the first to third optical films 6, 7, 9 are not always necessitated, and at least one of them may be used. In addition, any of the front surface of the display panel 2 and the front and back surfaces of the protection plate 1 may be selected as the surface to which the infrared absorption film 8 is stuck.

In the display panel in which the above films are provided, since luminance of the red fluorescent layer 25R and spectrum are overlapped and part of red luminance is cut off, luminous quantity of the red fluorescent layer 25R is preferred to be increased in advance so as to supplement the cut-off components. In particular, bright red fluorescent layer may be selected, or an area of the red fluorescent layer 25R may be formed wide rather than areas of blue and green fluorescent layers 25B, 25G.

In the meanwhile, a clearance (distance) is needed between the protection plate 1 and the front transparent substrate 21. This clearance must be ensured to relax static load and impact load carrying capacity or to reduce heat transfer from the display panel 2 to the protection plate 1, in addition to prevent Newton rings due to contact of the front transparent substrate 21 with the protection plate 1.

In the event that constituting materials for the protection plate 1 and the front transparent substrate 21 have different thermal expansion coefficient, it is not preferable that the display panel 2 and the protection plate 1 are arranged to have contact with each other since bowing of the protection plate 1 occurs owing to heat radiated from the display panel 2.

In the above discussion, although gas mixture consisting of Ne and Xe has been sealed in the display panel 2, gas mixture mainly consisting of Ne and He, gas mixture into which Ar gas, Xe gas, or the like is added, and the like may be sealed instead of the Ne and Xe gas mixture. Radiant quantity of the lights emitted from the PDP device due to these gas mixture other than the visible rays can be reduced by the above structure. For example, gas mixture of Ne and Xe, gas mixture of He and Xe, gas mixture of He, Ar and Xe, or gas mixture of Ne, Ar and Xe, and others may be used as such gas.

By adding Ar, Xe, etc. into the Ne and He base gas mixture, or by adjusting a mixture ratio of these gases, the optical filter characteristic to absorb or reflect selectively unwanted lights may be given to these gases.

For the purposes of example, to suppress emission of infrared rays from the color PDP device, such a structure may be employed in addition to the above film laminated structure that a mixture ratio of Xe to the gas mixture consisting of Ne and Xe which are sealed in the display panel 2 is set less than 2%. That is to say, the content of Xe may be selected to such an extent that radiant quantity of near infrared rays can be reduced rather than the case where the mixture ratio of Xe is 2%. It is desired that the mixture ratio of Xe is selected such that spectrum intensity of the near infrared rays is below the half of spectrum intensity of the visible ray wavelength, preferably less than ⅓ of spectrum intensity of the visible ray wavelength.

Figure 2A:
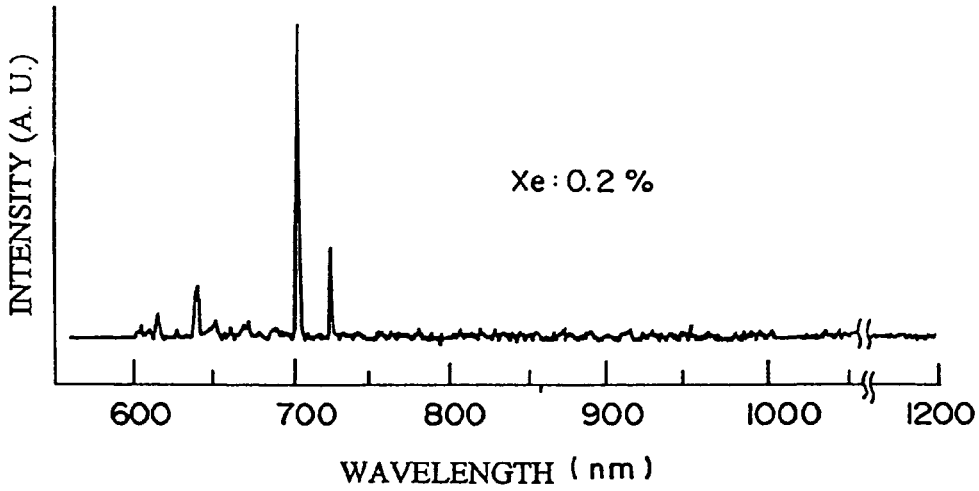
FIGS. 2A to 2C are views each showing emission spectrum in the range 400 nm to 1200 nm according to difference in the mixture ratios 0.2%, 2% and 3% of xenon in a device according to an embodiment of the present invention.

By the way, if the mixture ratio of Xe is below 2%, luminescence color of Ne, i.e., the light having wavelength of around 700 nm becomes conspicuous, as shown in FIG. 2A. As a result, it is likely that chromatic purity is deteriorated as the color PDP and that chromaticity of red, blue, and green primary colors is lowered.

Figure 13:
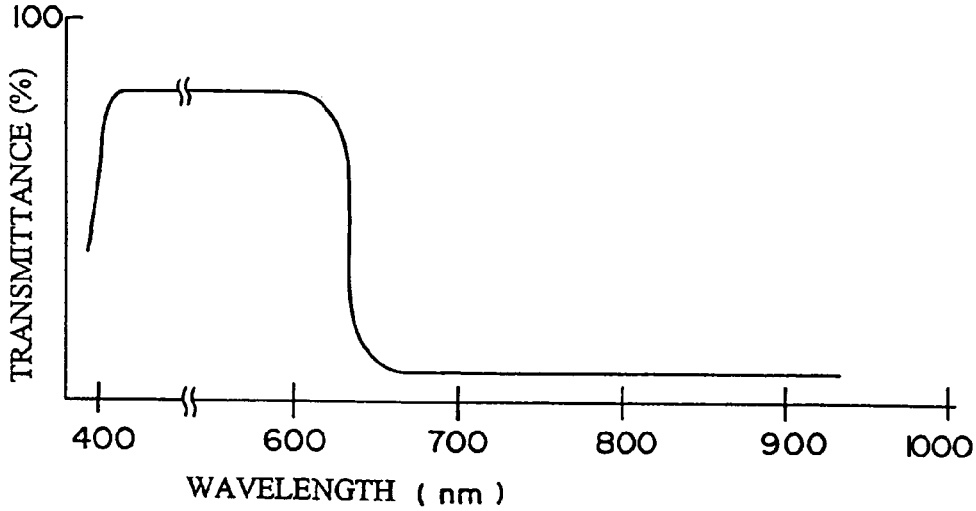
FIG. 13 is a view showing an optical characteristic of an optical absorption filter or a reflection filter to cut off lights within a particular wavelength bandwidth used in the device according to the embodiment of the present invention.
Figure 14:
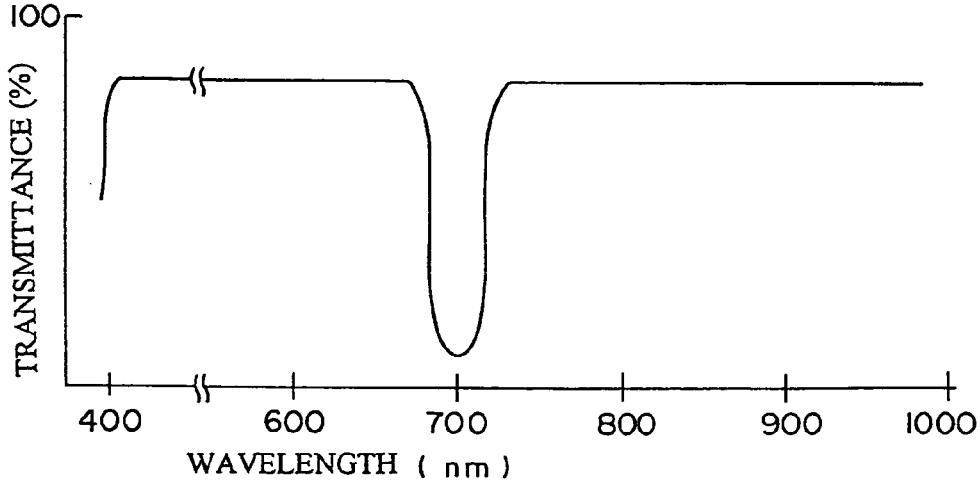
FIG. 14 is a view showing an optical characteristic of the optical absorption filter or the reflection filter to cut off lights having particular wavelengths used in the device according to the embodiment of the present invention.
Figure 15:
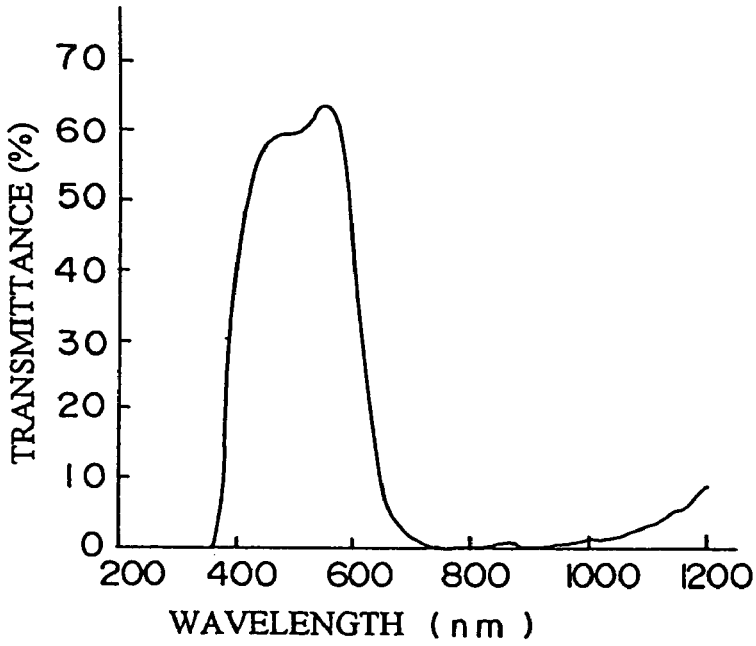
FIG. 15 is a view showing a characteristic of a first filter in the device according to the embodiment of the present invention to reduce transmittance of the lights around the wavelength of 700 nm.
Figure 16:
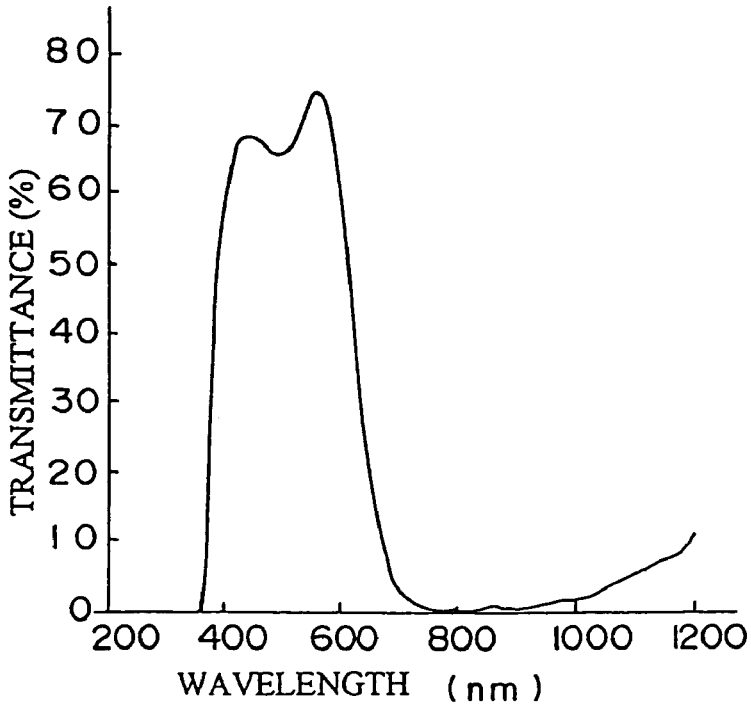
FIG. 16 is a view showing a characteristic of a second filter in the device according to the embodiment of the present invention to reduce transmittance of the lights around the wavelength of 700 nm.
Figure 17:
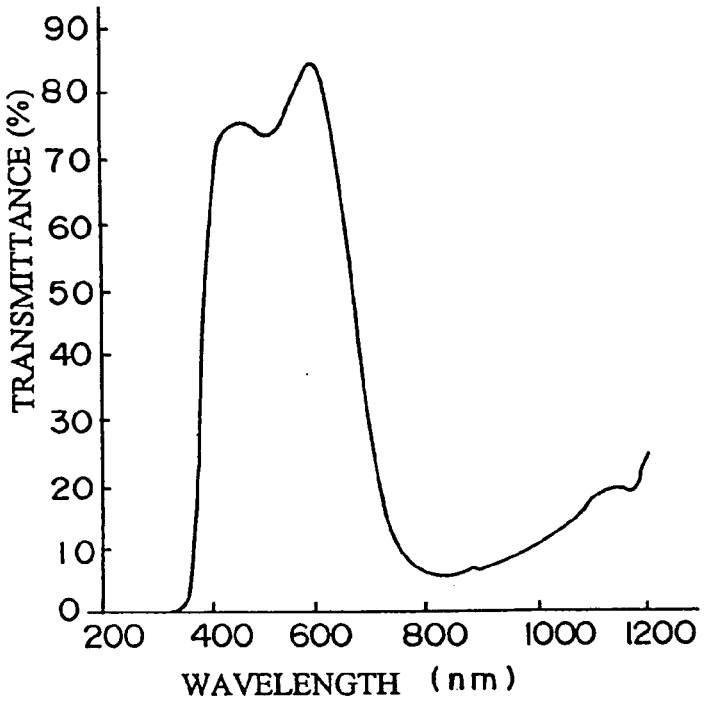
FIG. 17 is a view showing a characteristic of a third filter of the device according to the embodiment of the present invention to reduce transmittance of the lights around the wavelength of 700 nm.
Figure 18:
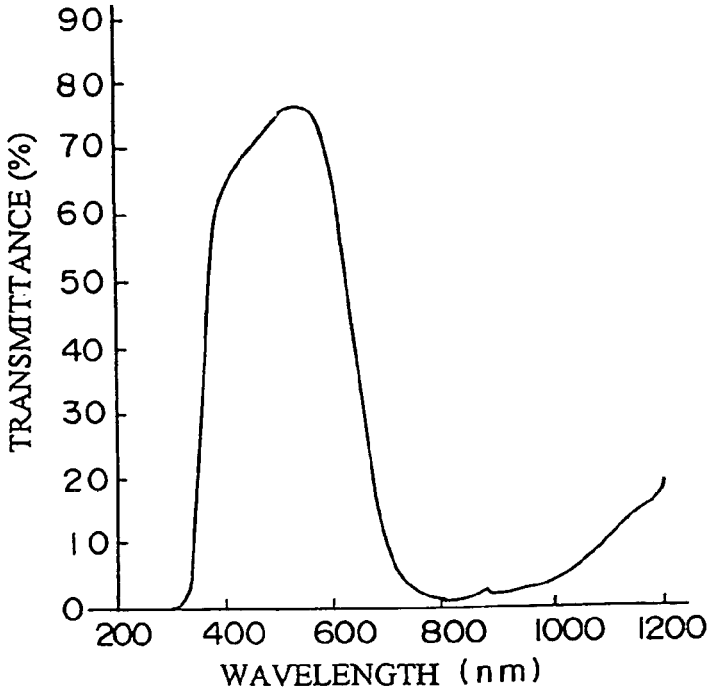
FIG. 18 is a view showing a characteristic of a fourth filter of the device according to the embodiment of the present invention to reduce transmittance of the lights around the wavelength of 700 nm.

Hence, by sticking an optical film, which has a characteristic to absorb or reflect the lights with the wavelength of more than 650 nm, on the protection plate 1 or the front transparent substrate 21, as shown in FIG. 13, or by sticking a filter, which has a characteristic to absorb or reflect selectively the wavelength of around 700 nm, on the protection plate 1 or the front transparent substrate 21, as shown in FIG. 14, reduction in chromaticity can be prevented. Unless the optical film is used, the protection plate 1 or the front transparent substrate 21 having a characteristic to absorb or reflect such wavelength may be used.

In order to reduce radiant quantity of the light having the wavelength of around 700 nm emitted from the PDP, transmittance of the lights having the wavelength of less than 650 nm is preferred to be set more than twice as high as transmittance of the lights having the wavelength of around 700 nm. For example, filters having wavelength vs optical absorption characteristic shown in FIGS. 15 to 18 may be employed.

Figure 2B:
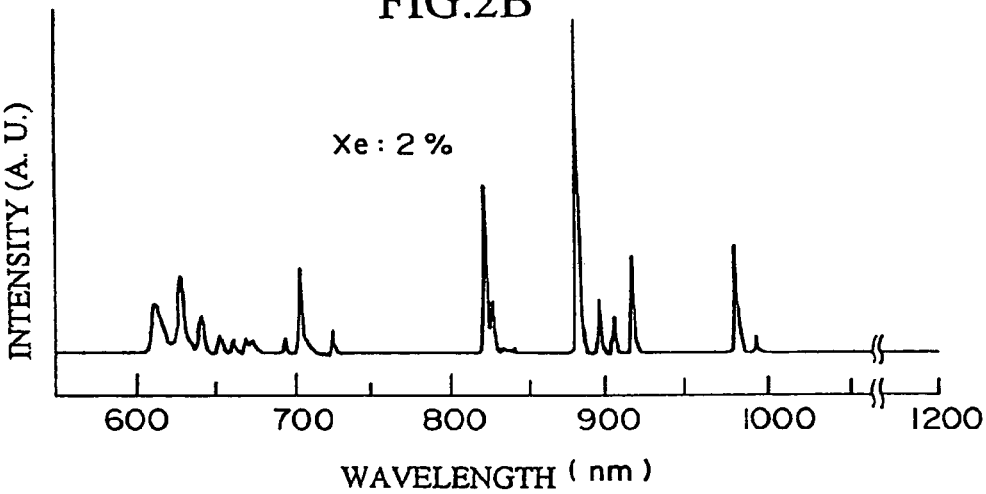
Figure 2C:
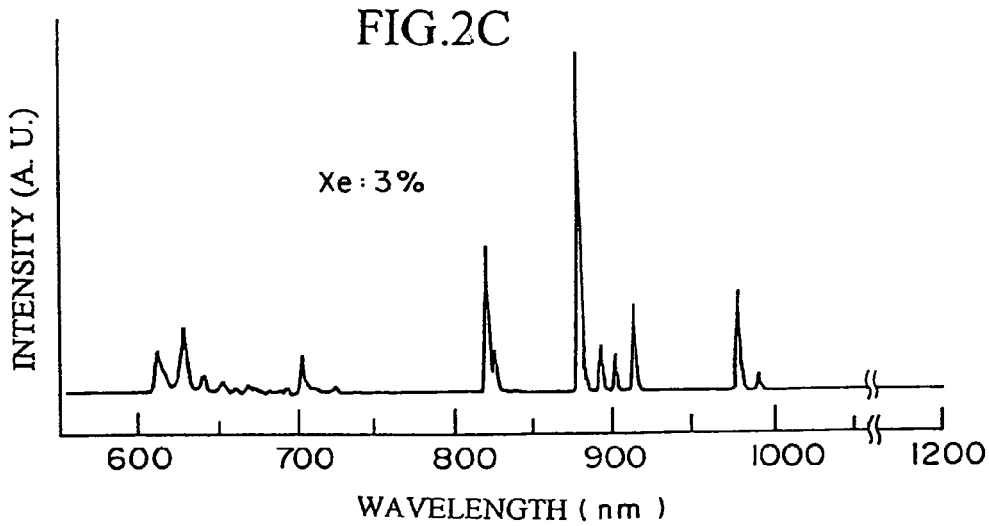
Figure 3A:
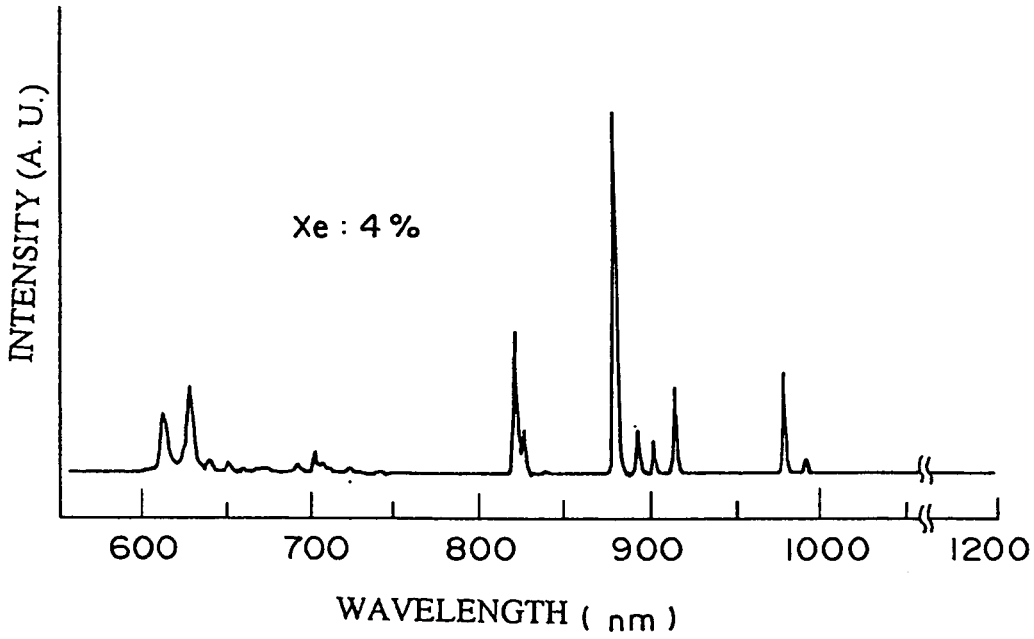
FIGS. 3A and 3B are views each showing emission spectrum in the range 400 nm to 1200 nm according to difference in the mixture ratios 4% and 5% of xenon in the device according to the embodiment of the present invention.
Figure 3B:
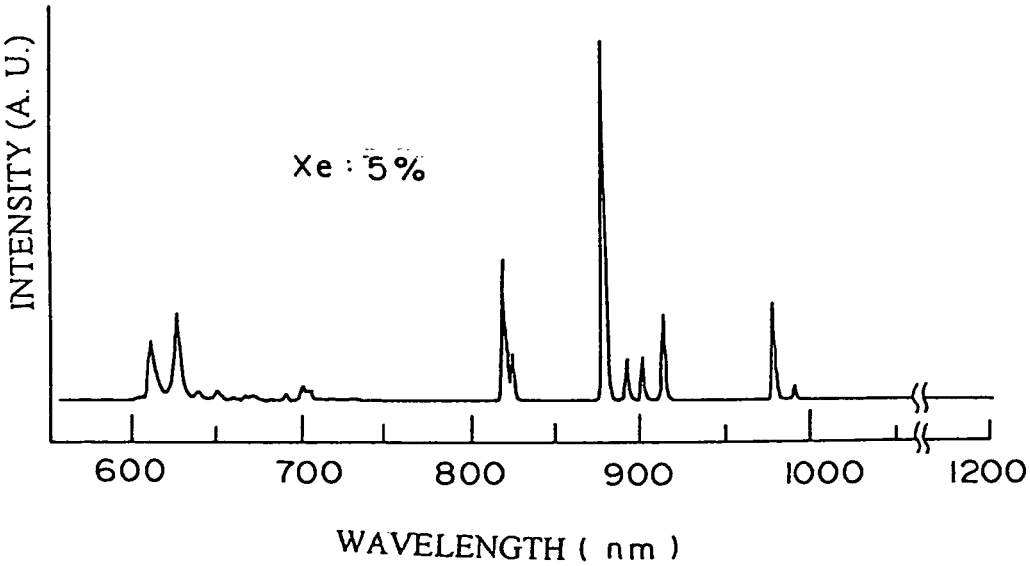

As shown in FIGS. 2B and 2C, even in the case where the mixture ratio of Xe is less than 2%, since a small peak of spectrum intensity appears in the wavelength band of around 700 nm, an optical film to absorb or reflect the lights having the wavelength of more than 650 nm is desired to be adhered to the protection plate 1 or the front transparent substrate 21 to improve chromatic purity.

When the above various films are stuck to the protection plate 1 or the front transparent substrate 21, a laminate method is used. These films may be laminated on an electrode forming surface side of the front transparent substrate 21. Furthermore, for infrared absorption, electromagnetic wave shielding, visible ray transmittance, or infrared reflection, not only those being formed as a film previously but also those being formed by depositing or coating infrared absorption material, electromagnetic wave shielding material, visible ray transmitting material, or infrared reflection material on the surface of the protection plate 1 or the front transparent substrate 21 may be used. Besides, in place of these films, another films having such optical function may be formed by a film forming method such as evaporation, CVD, or sputtering.

Figure 19A:
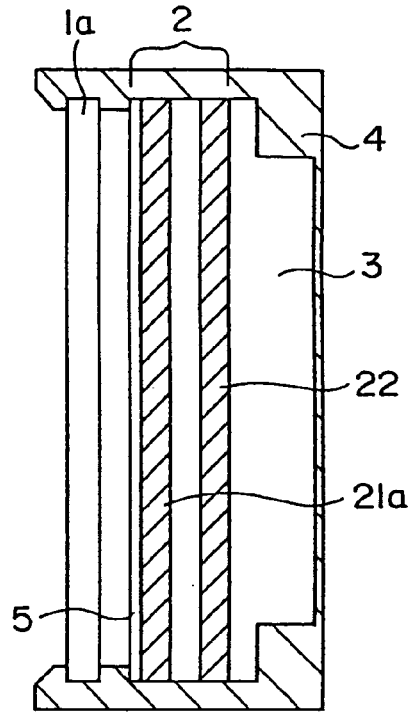
FIG. 19A is a schematic view showing a structure of a device according to a second embodiment of the present invention.
Figure 19B:
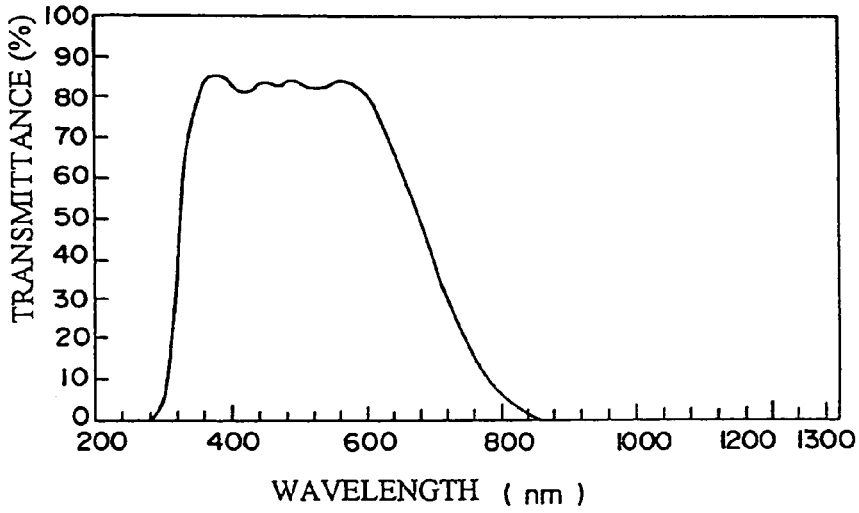
FIG. 19B is a view showing an optical characteristic of a protection plate or a front transparent substrate used in the device in FIG. 19A.

Various dye for absorbing predetermined wavelengths may be applied to a surface of the protection plate 1 or the front transparent substrate 21, or the aboves may be used in combination. In this fashion, if a function for absorbing the lights other than visible rays is provided to the protection plate 1 or the front transparent substrate 21, lamination of the film can be omitted, as shown in FIG. 19A. As a result, assembling steps required for the PDP device can be lightened. A relationship between optical transmittance and wavelength in such protection plate 1 or front transparent substrate 21 is illustrated in FIG. 19B.

By adopting a method using steps of adding inorganic substance and organic substance to material of the plate or film, then melting the resultant structure at an appropriate temperature and in appropriate atmosphere, and then annealing the resultant structure, a plate or film for reflecting or absorbing the lights having the wavelength other than visible rays may be formed on the protection plate 1 or the front transparent substrate 21 or the above filters.

For the purposes of example, if the protection plate 1 is formed of acrylic resin in terms of extruding process, heating temperature at 150 to 170 Ž, heating time for five to twenty minutes, applied pressure at 15 to 50 g/cm$^2$, and pressure applying time for ten to thirty minutes are selected. If organic compound dye such as anthraquinone system, or phthalocyanine system, or dye such as organic compound of metal complex is added to the acrylic material, for example, a near infrared absorption function may be provided to the protection plate 1. Such dye may be added to the dielectric layer 28 covering the display electrode pairs.

In the event that the film for reflecting or absorbing the lights having the wavelength other than visible rays is formed, it may be coated on the substrate by using already known thin film forming method like vacuum deposition method, high-frequency ion plating method, or magnetron sputtering method.

In addition, if the film for reflecting or absorbing the lights having the wavelength other than visible rays is formed on various films, powders such as inorganic substance and organic substance, dye or ion crystal may be pasted by being mixed or kneaded on the plate to form the film.

The absorption wavelength bandwidth and the reflection bandwidth of respective filters discussed above may be readily achieved by selecting and adjusting a thickness of the currently available filter, an amount of added material, and the like. Although the AC type color discharge panel has been described in the above embodiment, the present invention is not limited to this panel, but may be applied to a DC type color discharge panel, monochromatic AC type or DC type discharge panel similarly, for example.

With the above discussion, according to the present invention, since the flat display device is provided with means for reflecting or absorbing at least near infrared rays in wavelength bandwidth other than visible rays, malfunction of the devices using near infrared rays can be prevented.

In addition, since an optical film serving as an anti-reflection film with respect to visible ray wavelengths and serving as a reflection and absorption film with respect to near infrared wavelengths is used as means for reflecting or absorbing near infrared rays, visible rays can be emitted from the flat display device to the outside without reflection and absorption in the flat display device. As a result, degradation in luminous display brightness of the flat display device can be prevented. Scattering of the protection plate and panel (glass) can be also prevented.

Further, since the flat display device is provided with the electromagnetic wave shielding film as well as means for reflecting or absorbing near infrared rays, harmful influence upon a human body can be suppressed.

Furthermore, since, in the flat display device, the protection plate consisting of glass, acrylic resin, or plastic is arranged in front of the substrates which define the discharge space, radiation of the light having shorter wavelength than visible rays can be suppressed and in addition the structure of the device can be reinforced. Since the protection plate is formed to have a convex shape, or the periphery of the protection plate is attached securely into the frame member, structural strength of the protection plate can be improved.

In the present invention, since xenon and neon are included in the gas discharge space in the flat display device such that xenon comprises a less than 2% of the total, the radiant quantity of the light emitted from the flat display device and having 800 nm to 1209 nm wavelength can be extremely reduced. As a result, harmful influence upon the devices which are operated by near infrared rays can be prevented.

Since the flat display device is provided with means for absorbing or reflecting the light having the wavelength beyond 650 nm, the radiant quantity of the light around about 700 nm can be reduced to thus suppress deterioration in chromatic purity and chromaticity of color display.

In this event, if transmittance of the light having the wavelength below 650 nm is set more than twice as high as transmittance of the light having the wavelength of 700 nm, optical intensity at the wavelength can be reduced to thus suppress deterioration in chromatic purity and chromaticity of color display.

In the present invention, if the mixture ratio of the gas mixture is set such that spectrum intensity of infrared rays is less than the half of spectrum intensity of visible ray wavelength in the gas discharge space of the flat display device, influence upon the devices except the flat display device can be reduced.

Various modifications will become possible for those skilled in the art after receiving the teachings of the present disclosure without departing from the scope thereof.

What is claimed is:

1. A flat display device, comprising:

a display panel including a pair of substrates defining a gas discharge space in which a gas mixture including at least xenon is sealed, a mixture ratio of said xenon in said gas mixture being equal to or greater than 2% to afford a luminous spectrum comprised of near infrared rays; and said display panel having a material suppressing said near infrared rays.

2. The flat display device according to claim 1, wherein said material provided on a front substrate of said pair of substrates.

3. The flat display device according to claim 1, wherein said material is formed of a near infrared absorbent which is added to a front substrate of said pair of substrates.

4. The flat display device according to claim 1, wherein said material is formed of a near infrared absorbent and display electrodes, for discharging the gas between said pair of substrates, are covered with a dielectric film including a near infrared absorbent.

5. A flat display device, comprising:

a display panel, comprising:

a front transparent substrate, a plurality of display electrodes on the front transparent substrate, a back substrate opposed to the front transparent substrate and defining a gas discharge space therebetween in which a gas used to generate a discharge is sealed, a plurality of address electrodes provided on the back substrate, and fluorescent layers covering respective address electrodes;

a protection plate at a predetermined distance from said display panel; and a material formed on said protection plate and transmitting visible rays emitted from said fluorescent layers when irradiated with ultraviolet rays, generated by said gas discharge and suppressing near infrared rays generated together with said ultraviolet rays by said discharge.

6. A flat display device generating a discharge luminance, comprising:

a pair of substrates defining a gas discharge space in which a gas, used to generate the discharge luminance, is sealed; and a protection plate in front of said pair of substrates, the protection plate having a material suppressing near infrared rays emitted by the generated discharge luminance; and a casing accommodating said pair of substrates and said protection plate.

7. The flat display device according to claim 6, wherein said material is formed on a front surface or a back surface of said protection plate.

8. The flat display device according to claim 6, wherein said material is formed of a near infrared absorbent which is added to said protection plate.

9. A flat display device, comprising:

a pair of substrates defining a gas discharge space in which a gas mixture including at least Xenon is sealed, a mixture ratio of said xenon in said gas mixture being equal to or greater than 2% to afford a luminous spectrum comprised of near infrared rays; and a material suppressing said near infrared rays emitted from said gas mixture.

10. The flat display device according to claim 9, further comprising:

a protection plate in front of said pair of substrates; and said material being formed on a front surface or a back surface of said protection plate.

11. The flat display device according to claim 9, further comprising:

a protection plate in front of said pair of substrates; and said material being formed of a near infrared absorbent which is added to said protection plate.

* * * * *